US008674290B2

(12) United States Patent
Masnyk et al.

(10) Patent No.: US 8,674,290 B2
(45) Date of Patent: Mar. 18, 2014

(54) METHOD FOR MONITORING OR TRACING OPERATIONS IN WELL BOREHOLES

(76) Inventors: Robert Michael Masnyk, Calgary (CA); Hermann Kramer, Calgary (CA)

( * ) Notice: Subject to any disclaimer, the term of this patent is extended or adjusted under 35 U.S.C. 154(b) by 54 days.

(21) Appl. No.: 13/496,736

(22) PCT Filed: Sep. 16, 2010

(86) PCT No.: PCT/CA2010/001446

§ 371 (c)(1),
(2), (4) Date: Mar. 16, 2010

(87) PCT Pub. No.: WO2011/032279

PCT Pub. Date: Mar. 24, 2011

(65) Prior Publication Data

US 2012/0175511 A1 Jul. 12, 2012

Related U.S. Application Data

(60) Provisional application No. 61/242,847, filed on Sep. 16, 2009.

(51) Int. Cl.
*G01V 5/04* (2006.01)

(52) U.S. Cl.
USPC ..... 250/259

(58) Field of Classification Search
USPC ..... 250/259
See application file for complete search history.

(56) References Cited

U.S. PATENT DOCUMENTS 3,825,753 A * 7/1974 Givens ..... 376/166
3,965,982 A 6/1976 Medlin
3,987,850 A 10/1976 Fitch
4,052,613 A * 10/1977 Murphy et al. ..... 250/259
4,067,389 A 1/1978 Savins
4,078,174 A * 3/1978 Goldman ..... 376/165
4,378,845 A 4/1983 Medlin et al.
4,515,214 A 5/1985 Fitch et al.
4,549,608 A 10/1985 Stowe et al.
4,685,519 A 8/1987 Stowe et al.
7,511,266 B1 * 3/2009 Bothner ..... 250/269.2
8,044,342 B2 * 10/2011 Galford et al. ..... 250/269.6
8,100,177 B2 * 1/2012 Smith et al. ..... 166/250.1
8,214,151 B2 * 7/2012 Duenckel et al. ..... 702/8
8,234,072 B2 * 7/2012 Smith et al. ..... 702/8

* cited by examiner

*Primary Examiner* — David Porta
*Assistant Examiner* — Edwin Gunberg
(74) *Attorney, Agent, or Firm* — Eduardo Krupnik; Miller Thomson LLP

(57) ABSTRACT

The present invention relates to novel methods for monitoring or tracing a job operation performed in a borehole, such as well boreholes traversing a geological formation. In one embodiment, the novel methods of the invention comprise the steps of: (a) disposing into the borehole a neutron absorber during the performance of the job operation; (b) logging the borehole with an instrument capable of measuring a neutron capture in and around the borehole after performance of the job operation; and (c) monitoring or tracing the job operation performed in the borehole by comparing the measured neutron capture with a baseline neutron capture in and around the borehole. The methods of the present invention pose small or no risk from a health safety and environment perspective and are useful for monitoring or tracing hydraulic fracturing, cementing operation in well boreholes, production logging or subsurface location of downhole collars, float shoes and other jewellry.

10 Claims, 6 Drawing Sheets

METHOD FOR MONITORING OR TRACING OPERATIONS IN WELL BOREHOLES

CROSS REFERENCE TO RELATED APPLICATIONS

This application is a national stage application under 35 U.S.C. 371 of International Application No. PCT/CA2010/001446, filed Sep. 16, 2010, which in turn claims the benefit under 35 U.S.C. 119(e) of U.S. Provisional Ser. No. 61/242,847, filed Sep. 16, 2009, the contents of each of which are hereby incorporated by reference into the present disclosure.

FIELD OF THE INVENTION

The present invention relates to novel methods for monitoring or tracing job operations in boreholes with the use of neutron absorbers such as boron and cadmium.

BACKGROUND OF THE INVENTION

It is oftentimes desirable to fracture boreholes in order to increase or restore the permeability of fluids such as oil, gas or water into the borehole thereby increasing the production of oil, gas, and/or water from the borehole. Hydraulic fracturing is a technique commonly used in the oil industry to create fractures that extend from an oil borehole into rock. Such fracturing is accomplished by injecting a suitable fracturing fluid within the borehole. Thereafter, sufficient pressure is applied to the fracturing fluid in order to cause the formation to break down with the attendant formation of one or more fractures therein. Simultaneously with or subsequent to the formation of the fracture a suitable carrier fluid having suspended therein a propping agent or proppant such as sand or other particulate material is introduced into the fracture to hold the fracture open after the fluid pressure is released. Typically, the fluid containing the proppant is of a relatively high viscosity in order to reduce the tendency of the propping agent to settle out of the fluid as it is injected down the well and into the fracture.

Hydraulic fracturing methods are disclosed in U.S. Pat. Nos. 3,965,982; 4,067,389; 4,378,845; 4,515,214; 4,549,608 and 4,685,519, for example. Hydraulic fracturing is sometimes performed on very thick pays. As a result, fractures are induced in stages along the length of a borehole, creating multiple reservoir zones along the borehole.

The extent of hydraulic fracturing and the location of proppant materials is currently diagnosed by the use of radioactive tracers as described in U.S. Pat. No. 3,987,850. Typically, radioactive tracers with discriminating gamma energy signatures are displaced into the various stages of a fracturing operation at predetermined activities that can be measured using multi-spectral gamma ray tools used in wireline logging operations. The conventional method of introducing radioactive tracers into the fracturing fluids is by surface injection. This allows for the determination of various subsurface zones in affected intervals that have been tagged.

The use of radioactive tracer materials for tracing subsurface zone location from hydraulic fracturing operations poses a high risk from a health safety and environment ("HSE") prospective. The risk of dispersing radioactive material is high with respect to uncontrolled variables such as equipment failure leading to the release of a radioactive tracer material, or the retention of radioactive tagged fracturing fluids in piping and blending or well head equipment, either by mechanical deposition or chemical reaction leading to fixed or loose radioactive contamination of the exposed items. The presence of radioactive materials and contamination in the environment leads to pollution and burdens from exposure of gamma/beta emitting radioisotopes to people and anything in close proximity to them.

What is needed is a new method and compositions that allow fracture and other borehole operation diagnostics to be performed with small or no risk from an HSE perspective from both initial surface injection operations, exposure to equipment and from the recovery of tagged effluents when the well is flowed back.

SUMMARY OF THE INVENTION

In one embodiment, the present invention provides for a method for monitoring or tracing a job operation performed in a borehole characterized in that the method comprises: (a) disposing into the borehole a neutron absorber during the performance of the job operation; (b) logging the borehole with an instrument capable of measuring a neutron capture in and around the borehole after performance of the job operation; and (c) monitoring or tracing the job operation performed in the borehole by comparing the measured neutron capture with a baseline neutron capture in and around the borehole.

In another embodiment the present invention provides a method of discerning between relative near and relative far borehole placement of a fluid displaced in the borehole, characterized in that said method comprises: (a) tagging the fluid with a neutron absorber; (b) disposing the tagged fluid into the borehole; (c) logging the borehole with an instrument capable of measuring a neutron capture and a gamma radiation response in and around the borehole; and (d) comparing the neutron capture and gamma radiation measurements with a baseline neutron capture and gamma radiation measurements of the borehole, wherein a decrease in both neutron capture and gamma radiation represents relative near borehole placement of the fluid, and wherein a decrease in only the neutron capture represents a relative far borehole placement of the fluid.

Advantages of the present invention include, a method for tracing subsurface fractures that:

(a) do not pose risks from a health, safety and environment prospective;

(b) do not result in the dispersal of radioactive materials;

(c) by partitioning and tagging individual segments of a fractioning stage, it is possible to discern stage placement and direction of travel;

(d) by comparing both neutron neutron and neutron gamma responses before and after fractioning, it is possible to discern between near well bore and non-near well bore placements of fracturing proppants and fluids.

One embodiment of the present invention involves using boron carbide particles as a tag material. Boron carbide is a ceramic compound that has a 75% abundance of boron by weight and the same density as silica. It is a compound that is chemically inert under typical conditions of hydraulic fracturing. Because boron is a neutron absorber, post-frac detection is accomplished by using a neutron device utilizing an Am-241Be sealed source which detects descending neutron and gamma count rates, as well as, capture gamma validation by energy discrimination across tagged intervals. This method will give both near and not near well bore dimension and provides Neutron-Neutron (N-N) and Neutron-Gamma (N-G) differences against initial base line reference data.

BRIEF DESCRIPTION OF THE DRAWINGS

The invention will be better understood and objects of the invention will become apparent when consideration is given to the following detailed description thereof. Such description makes reference to the annexed drawings wherein.

Figure 1:
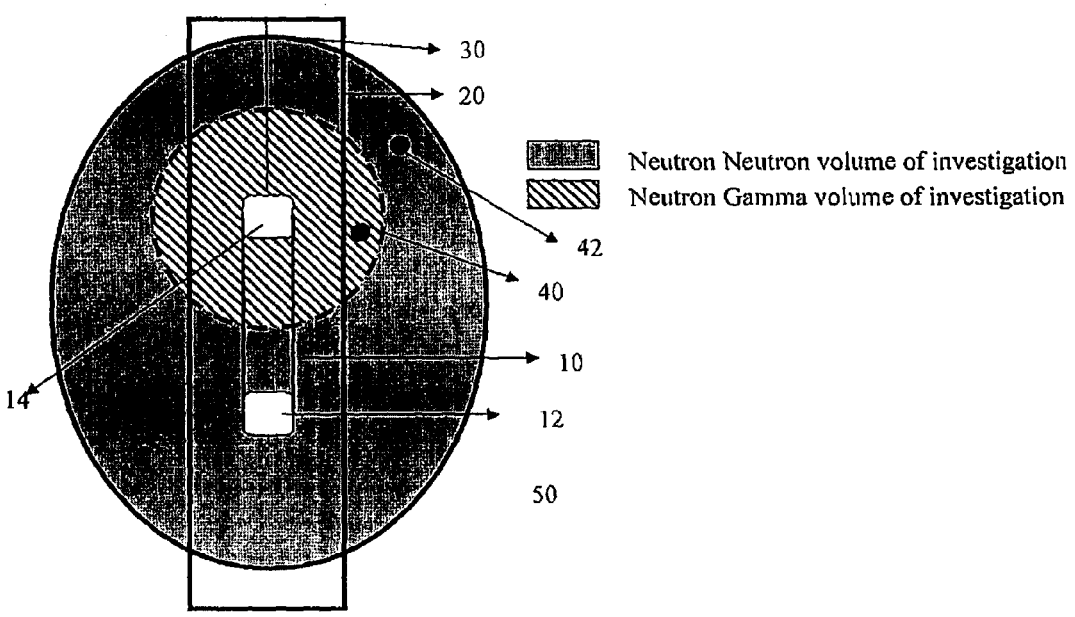
FIG. 1 is a graph illustrating a theoretical neutron tag effects, capture gamma tag effects and no tag effects.

In the drawings, embodiments of the invention are illustrated by way of example. It is to be expressly understood that the description and drawings are only for the purpose of illustration and as an aid to understanding, and are not intended as a definition of the limits of the invention.

DETAILED DESCRIPTION OF THE INVENTION

Unless defined otherwise, all technical and scientific terms used herein have the same meaning as commonly understood by one of ordinary skill in the art to which this invention belongs. Also, unless indicated otherwise, except within the claims, the use of "or" includes "and" and vice-versa. Non-limiting terms are not to be construed as limiting unless expressly stated or the context clearly indicates otherwise (for example "including", "having" and "comprising" typically indicate "including without limitation"). Singular forms including in the claims such as "a", "an" and "the" include the plural reference unless expressly stated otherwise.

The invention will be explained in details by referring to the figures.

The Applicant made the surprising discovery that the measurement of a neutron capture of a formation tagged with a neutron absorber can be used for profiling, monitoring or tracing an operation performed in a borehole traversing a geological formation.

As such, the present invention provides for methods and compositions useful for monitoring or tracing a job operation performed in a borehole traversing a geological formation. In one embodiment of the present invention the method for monitoring or tracing a job operation performed in a borehole traversing a geological formation may comprise: (a) disposing into the borehole a neutron absorber during the performance of the job operation; (b) logging the borehole with an instrument capable of measuring a neutron capture in and around the borehole after performance of the job operation; and (c) monitoring or tracing the job operation performed in the borehole by comparing the measured neutron capture with a baseline neutron capture in and around the borehole.

In one aspect of the present invention, both neutron capture (neutron neutron (NN)) and gamma radiation response (neutron gamma (NG)) may be measured to monitor or trace the job performed in the borehole. In another aspect, NN, NG and natural gamma radiation arising from the formation may be measured to monitor or trace the job performed in the borehole. By using more than one measurement, for the first time, it becomes possible to profile, monitor or trace the relative depth of fractures that may be created in the formation during the hydraulic fracturing of a borehole.

FIG. 1 represents a downhole physical model of a homogenous formation with the neutron absorber tags 40, 42 present and a logging tool 10 inside the borehole 20 traversing formation 50. Logging tool 10 may have a neutron source 12 and a neutron detector 14. Logging tool 10 may be held in position via a cable 30 from the surface. The assumption is that the neutrons will travel further than any gamma ray in this environment. High energy (fast) neutrons are emitted from the neutron source 12. The neutron neutron volume of investigation represents the theoretical paths a neutron may travel from the neutron source 12 to a neutron detector 14. Gamma radiation may be created as the neutron becomes thermalized. The higher gamma activity occurs with the higher neutron energies. These gamma events may be detected by a gamma detector. If 14 represents a gamma detector, then the neutron gamma volume of investigation is, as depicted in FIG. 1, for the most part smaller (has less energy) than the neutron neutron volume of investigation. The effect of the neutron absorber tags 40, 42 is to eliminate neutrons. The loss of neutrons may be measured by the decrease in counts on the neutron detector 14. The presence of the neutron absorbers 40, 42 may be detected by a reduction in the neutron activity and an increase of high gamma energy. The inventors discovered that the neutrons eliminated early in the neutron gamma volume of investigation will cause a reduction in detectable gamma events. Accordingly, it was discovered that the presence of tags 40, 42 and the relative distance of neutron absorber tags 40, 42 in the formation from the detector 14 may be computed by observing the increase and decrease of counts on the neutron neutron count and the neutron gamma count.

During the job operation, a tag capable of absorbing neutrons may be disposed into the well borehole. For example, in the case of hydraulic fracturing, tags may be added to the fracturing fluid or to the proppant used in fracturing operations, or to the cement used in cementing operations. The formation may be logged with the logging tool to provide with NN, NG counts and/or natural gamma counts after disposing the neutron absorber into the well borehole. This post-disposing log may represent a measurement of the neutron response of both the baseline (background) NN count of the formation prior to the job operation, and the NN response due to the tag material disposed in the formation during the job operation. A comparison between the baseline NN measurement and the post-disposing measurement may serve to diagnose the operation, such as identify the extent of the fracture in the formation or the extent of deposition of the proppant within the fractured formation or the disposition of the cement about the well borehole.

It may be preferable to have a baseline log reference using the same logging tool.

Thus, in one embodiment of the methods of the present invention, a baseline log reference may be accomplished by lowering a logging tool down the borehole traversing the geological formation. While traversing the borehole, the logging tool may irradiate the formation with neutrons from a neutron source included in the logging tool. Detectors included in the logging tool may then measure the background or baseline NN, NG and/or natural gamma counts within the formation prior to the job operation.

Having established a baseline NN, NG, and natural gamma counts of the formation, the formation may then be submitted to the job procedure. Applications of the methods and system of the present application are described below.

The baseline log reference, however, may not be necessary if previous NN and NG formation data is available by using normalization log processing techniques. A synthetic baseline may be produced using a combination of neutron to neutron and/or neutron to gamma measurements.

Reference data from any other nuclear measurement system may be made compatible using log normalization processing techniques known in the art. The concentration of tracer chemical may be increased in the injection profile of the job operation to offset statistical error resulting from the use of data obtained from a differing down borehole nuclear measurement system if a "lesser" logging tool is used. Lesser is defined as a tool that relies on smaller neutron population based on neutron source activity and energy or has less detector efficiency (increased K constant).

More definitive information may be determined if an initial baseline logging pass is conducted (i.e. two logging passes). This also allows for the preservation of original formation evaluation data prior to job operations.

The methods of the present invention may be practiced with N-N response only and with the use of a single detector neutron tool. The use of N-N, N-G logging tools may be used for more comprehensive log data such as discerning between near and not near well bore tag effects. As such, in one embodiment, the methods of the present invention may be used to discern between near well bore and non-near well bore placements of fracturing fluids, proppants, cement and other carriers by comparing the relative amounts of change on both neutron and gamma counts. FIG. 1 illustrates a schematic NN volume of investigation and the NG volume of investigation. For most formations, the NN field is larger than the NG field, as illustrated in FIG. 1. The Applicant, surprisingly, discovered that both neutron and gamma counts decrease when the tag material 40 is within both volumes of investigation (near well bore). Only neutron counts decrease when the tag material 42 is in the neutron volume of investigation only (non-near well bore).

In another embodiment, the methods of the present invention may be used to discern stage placement and direction of travel by partitioning and tagging individual segments of a fractioning stage. Non tagged stages displace previously tagged stages. This causes a non near borehole displacement of tag material which can be detected as discussed above.

As such, in another embodiment, the present invention provides for a method of discerning between relative near and relative far borehole placement of a fluid displaced in the borehole. The method of discerning between relative near and relative far borehole placement of a fluid displaced in the borehole may comprise the following steps: (a) tagging the fluid with a neutron absorber; (b) disposing the tagged fluid into the borehole; (c) logging the borehole with an instrument capable of measuring a neutron capture and a gamma radiation response in and around the borehole; and (d) comparing the neutron capture and gamma radiation measurements with a baseline neutron capture and gamma radiation measurements of the borehole. A decrease in both neutron capture and gamma radiation may represent relative near borehole placement of the fluid, and a decrease in only the neutron capture may represent a relative far borehole placement of the fluid.

The inventors discovered that by alternating tagged intervals in a multi or typical triple stage fractioning procedure, it may be possible to identify stage that does not have a tag. In this document, the stage that does not have a tag is referred to as a "window." The Inventors discovered, surprisingly, that windows may be detected as an increase in the nuclear count.

Suitable tag materials that may be used in the present invention include cadmium and boron, either in elemental or compound forms. Cadmium and boron, either in elemental or compound forms may be used to trace fracturing operations and determine subsurface zone location similar to the use of radioactive tracers of the prior art, but without any risk form radioactivity.

Both cadmium and boron are neutron absorbers that emit capture gamma rays when they absorb neutrons. Boron has a capture gamma energy at 0.48 MeV and cadmium at 2.26 MeV. Using neutron sources such as geophysical accelerators or radiochemical sources incorporated into down borehole nuclear measurements systems or logging tools, it is possible to measure the capture of the neutrons and the descending neutron count rates measured by the logging tool. The manipulation of particle sizing and concentration of the boron or cadmium tagging materials can be adjusted in the injection profile of a tracer material displacement into a job operation (i.e. hydraulic fracturing or other stimulation procedure, cement jobs, etc.) to determine subsurface zone location using the method of the invention. In addition, the logging tool can be used to initiate the nuclear process and release of the capture gamma energy that can be discriminated and measured while the tool passes by an interval of the formation tagged with the neutron absorber material.

The neutron activation of cadmium and/or boron atoms is a one time nuclear event and renders transmutation by products that are stable isotopes and pose zero risk from an HSE perspective from both initial surface injection operations, exposure to equipment and from the recovery of the tagged effluents when the well is flowed back.

In one aspect of the present invention, boron carbide (B4C) may be used as the neutron absorber. The carbon component in the boron carbide is an excellent element to thermalize neutrons while the boron has excellent ability to capture the thermalized neutron. Boron carbide, accordingly, provides for a "one two" combination for neutron measurement. B4C is also a ceramic and therefore is chemically inert under the existing physical and chemical conditions of a typical hydraulic fracturing operation or a cementing operations.

CB4 has a specific gravity of 2.5 g/cm$^3$ which is approximately the same as that of silica. Silica particulates are commonly used as proppants in fracturing operations or as an aggregate for mixing cement slurries. CB4 particle sizing can be matched to that of those materials used in these operations (proppant, etc.) and because of its similar density, will travel at the same velocity as pumped fluids giving a homogenous distribution of the tracer throughout a fluid displacement. In the application for fracturing operations, where discrimination between stages is required, differences between NN and NG measurements may be used to distinguish between pad and proppant stages by comparing baseline reference data versus the placement of silica proppants and CB4 tagged silica proppants. That is, it may be possible to look at multiple stages of a fracturing operation using the single CB4 tracer. It may be preferable to have a baseline log reference using the same tool; however, not totally necessary if previous N-N and N-G formation data is available by using normalization log processing techniques as described above. The methods of the present invention may be carried out with N-N response only and the use of a single detector neutron tool. The use of NN, NG logging tools may be used for more comprehensive log data such as near and not-near borehole tag effects. The methods of the present invention may use descending NN neutron count rate as a primary measurement.

CB4 is chemically inert and will not react with other chemicals. It has a few unique physical characteristics; in that it is one of only two elements that are neutron absorbers and it is the second hardest substance on the Moh's hardness scale, second only to diamonds. Boron captures a thermalized neutron (0.25 eV) and transmutates into Lithium under Alpha decay. Lithium does not pose an HSE risk. A previously mentioned, boron has a capture gamma energy of 0.48 MeV, which is ironically the same as the principal Gamma photon energy of iridium-192; the most common radioisotope currently used in oilfield tracing applications.

The second neutron absorbing element is cadmium. Cadmium is a heavy metal of a toxic nature. It is a carcinogen and its use as a tracer must be done with considerations made for potential personnel uptakes and burdens on the environment. Intrinsic cadmium particles may be used with a comprehensive quality control program that shows efficiency of the particle containment system to give a level of confidence with respect to particle integrity in this regard.

Because boron is a neutron absorber, detection may be accomplished by using a neutron device utilizing an Am-241Be sealed source which detects descending neutron and gamma count rates, as well as, capture gamma validation by energy discrimination across tagged intervals. This method will give both near and not near well bore dimension and provides neutron neutron (NN) and neutron gamma (NG) differences against initial base line reference data.

As noted above, the tag material may be added to a fluid carrier used in the performance of a job operation. For example, the tag material can be added to the proppant slurry used in hydraulic fracturing procedures at specified concentrations, as is. The neutron absorber tag material may also be added to the fracturing liquid at specified concentrations, as is. The tag material may also be added to the cement used in cementing operations. The neutron absorber may also be sprayed to downhole jewellery such as float shoes and collars. The range of concentrations can range from 1 $\mu g/cm^3$ to the saturation point of the compound in that particular liquid medium. The addition of boron or cadmium in water or oil soluble compounds in aqueous solution can be added to fracturing or any other fluids that are pumped down borehole. The solutions can be metered with volumetric liquid pumps that deliver a calibrated volume of a tagged solution with a specified molarity over a fluid displacement to give a desirable concentration by volume into fluids pumped down hole.

The use of present invention to tag alternate stages of a cement slurry displacement may be used to show the presence of light weight cement (<1500 kg/cubic meter) behind the casing of a well borehole. The addition of boron or cadmium wilt not interfere with the cross linking of the calcium silicate matrix in the cement slurry and not adversely affect the compressive or tensile strengths. It is recommended to log formation evaluation data prior to cement treatment to preserve original information.

The boron or cadmium tags may be added as solids with a screw feeder that is calibrated to deliver specific quantities by weight into or from feed hoppers that feed blending equipment. The concentrations of dry chemical may range from 1 PPM to 1,000,000 PPM. Experimental concentrations tested were from 200 to 500 $mg/cm^3$. The optimum concentration for the detection of boron carbide into any fluid displacement is 350 mg/cubic centimeter or 35 g/cubic meter.

Figure 5:
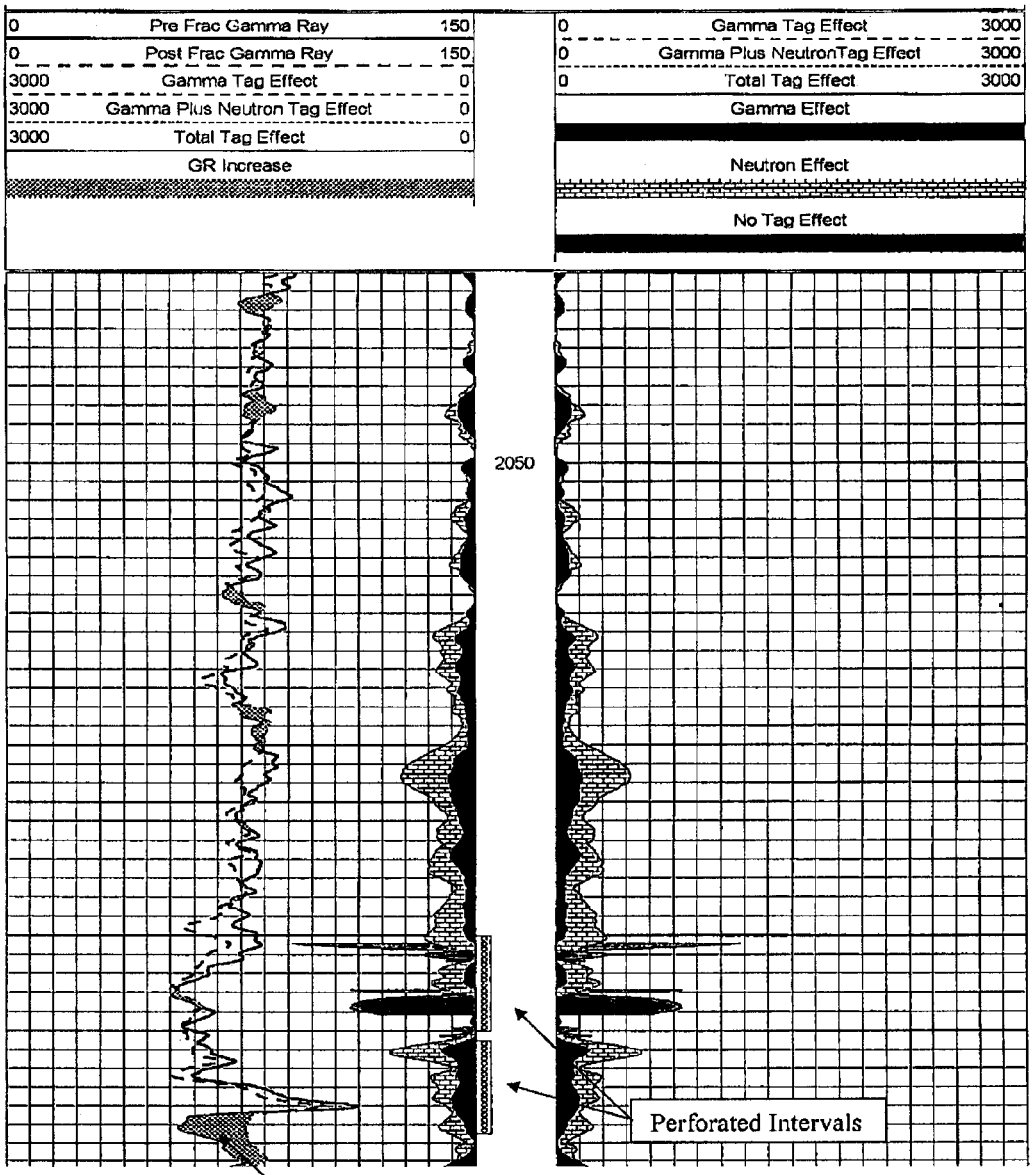
FIG. 5 illustrates a fracture analysis log showing near and not near gamma ray (pre and post frac), gamma plus neutron tag effects as an overlay.

As shown in FIG. 5, the inventors also discovered that the change in natural gamma ray may be used to monitor the erosion of the formation.

There are many options available with respect the selection of logging tools depending on the quality of information required. Examples include Roke "Quad Neutron" and the Hotwell PNN Geophysical accelerator or any other logging tool. The Quad Neutron utilizes a four detector array of electrically balanced NG and NN detectors. Using a combination of the data from these balanced detectors, the measurements may be derived. The balanced array configuration may reduce borehole effects and may allow for acquisition of data through casing and pipe strings.

For a CB4 well bore tracing during hydraulic fracture operation, an evaluation log with an appropriate logging tool may be obtained before the fracturing to obtain baseline neutron (N) and gamma (G) detector measurements. If this baseline cannot be obtained, then a synthetic baseline may be produced using a combination of NN and/or NG measurements. During the fracturing procedure, BC4 may be mixed at the blender into the proppant and may be carried into the formation by the carrier proppant fluid. The BC4 may be deposited alongside the proppant in the formation. After the fracturing operation, the well may be logged to measure the NN and/or NG in the formation. The differences between the baseline and the post-operation logs may then be analyzed to trace and/or monitor the job operation.

Applications

In this invention, an effort is being made to eliminate the use of open source radiochemicals as tracer materials in various applications. These applications include at least: (1) Tracing cement: boron carbide is definitive with respect to proving the presence of lightweight cement slurries (<1500 $kg/m^3$) typically used for surface cement and remedial intervention. (2) Tracing fluid placements in hydraulic fracturing operations; (3) Production logging for proving casing integrity, material flow and velocity rates; and (4) Subsurface location of downhole jewellery such as float shoes, collars, float collars and similar equipment which is inserted into the well borehole.

Economic Considerations

The use of tracer materials such as CB4 and cadmium may have some economic benefits to the operator during and after job operations including at least: (1) well flow back monitoring and the use of tanks for the retention of contaminated or radioactive tagged effluents is not required; this eliminates tank rentals and the cost of onsite personnel for extended periods of time; (2) The cost of CB4 tracer materials and services are equivalent or lower than costs associated with radioactive tracers; (3) The CB4 technology gives a permanent tracer signature on tagged wells that can be logged for years to come; and (4) The CB4 technology mitigates risk and the potential liabilities from a legal perspective.

The above disclosure generally describes the present invention. Changes in form and substitution of equivalents are contemplated as circumstances may suggest or render expedient. Although specific terms have been employed herein, such terms are intended in a descriptive sense and not for purposes of limitation. Other variations and modifications of the invention are possible. As such modifications or variations are believed to be within the sphere and scope of the invention as defined by the claims appended hereto.

The following examples and discussion concentrate on the application of the present invention in hydraulic fracturing scenario, however a person skilled in the art would comprehend other alternative implementations of the present invention as a natural extension of the present invention, such as cementing operations.

EXAMPLES

Example 1

Concept Verification

Theory: boron and cadmium have large thermal neutron cross-section capture area and emit a high energy gamma upon neutron capture.

Hypothesis: The presence of boron or cadmium should be detected by the decrease of neutron activity and the increase of high gamma energy.

Materials: 3-45 gallon drums; 5" metal exhaust pipe; frac sand; boron carbide tag, logging device containing Am241Be neutron logging source, thermal neutron detector, neutron gamma detector and natural gamma detector.

Figure 2:
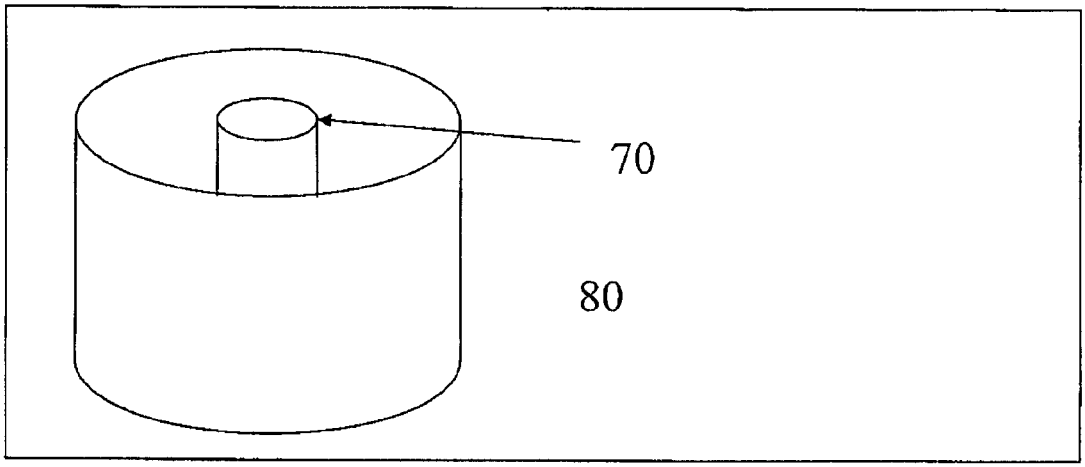
FIG. 2 illustrates perspective view of a test half barrel construction used for Example 1.

Method: Three 45 gallon metal barrels were cut in half 80 (refer to FIG. 2). A 5" hole 32 was cut in the center of the ends of each half barrel 80. A piece of 5" metal exhaust pipe 70 was inserted thru the hole 32 into the half barrel 80. The 5" exhaust pipe 70 was then welded onto the end of the barrel 80. Three of the half barrels 80 were filled completely with frac sand and fresh water. The remaining three half barrels 80 were filled with tagged frac sand (at different concentrations) and fresh water. The tag was added by pre mixing the tag component with a small amount of frac sand and then this mixture was gradually poured into the barrel along with the frac sand and water. Lids, with a 5" hole cut in the center, were then fastened on the top of each half barrel 80 with metal lid clamps. Each half barrel 80 was numbered. Half barrels 1, 2 and 3 were not tagged. Half barrels 4, 5 and 6 contained tagged sand at concentrations of 500, 200 and 375 $\mu m^3$, respectively.

Figure 3:
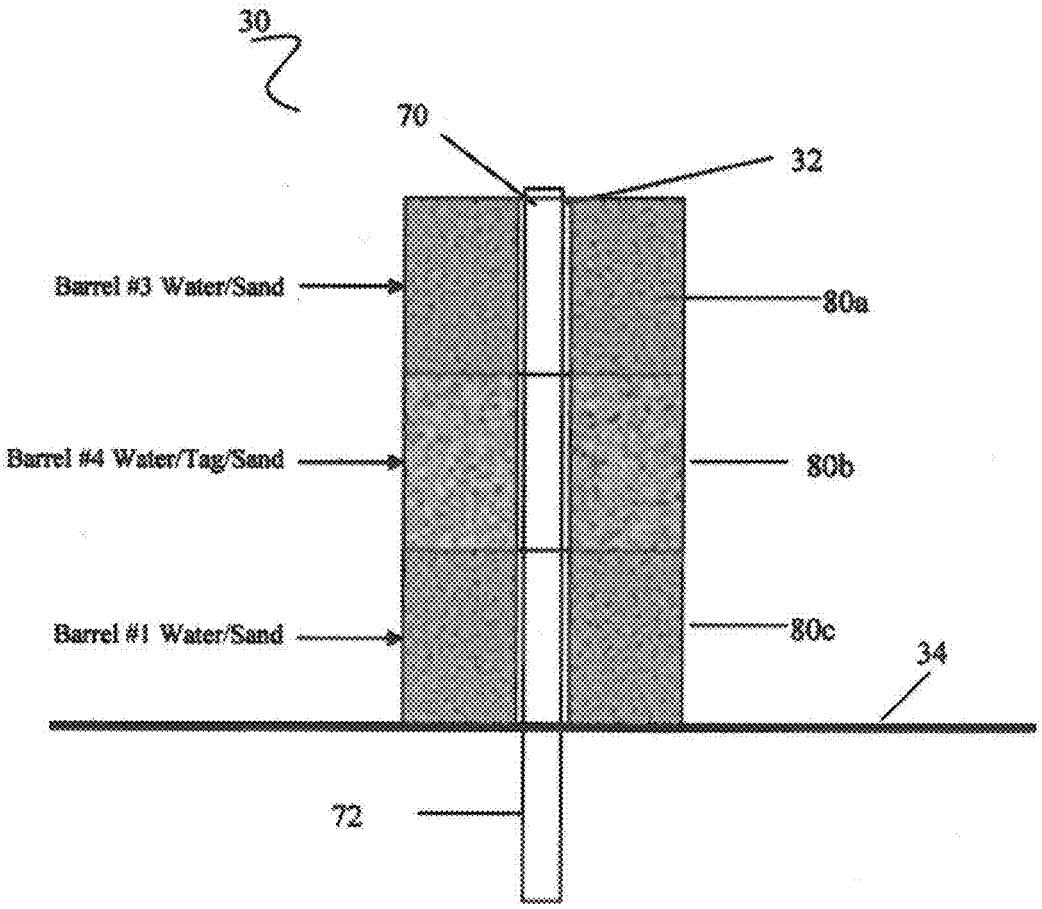
FIG. 3 illustrates a test well comprising three half barrel constructions stacked over a casing extension.

FIG. 3 illustrates a test well 30 used in this example. On the test well, a piece of 4.5" oil field casing 72 was added to extend the height of the well casing, to approximately 8' above ground level 34. Three half barrels 80*a*, 80*b*, 80*c* were then stacked over the casing extension 72 and the response of the logging device, containing the neutron source, neutron neutron (NN), neutron gamma (NG) and natural gamma detectors, was recorded in the casing across the barrels. Order of recordings (barrel numbers listed from top to bottom): Run 1 (baseline pass)—Barrels 3, 2 and 1 (no tag). Run 2—Barrels 3, 4 (200 $g/m^3$) and 1. Run 3—Barrels 3, 5 (500 $g/m^3$) and 1, Run 4—Barrels 3, 6 (375 $g/m^3$) and 1.

Figure 4:
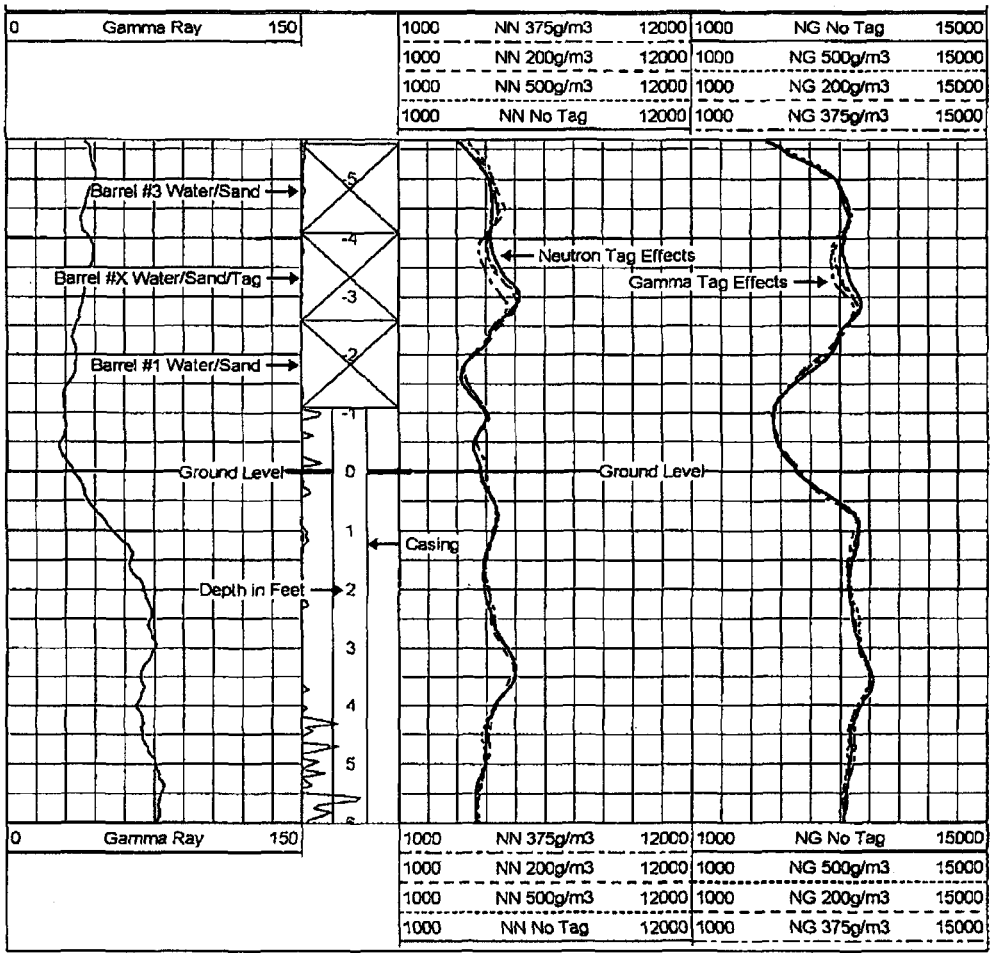
FIG. 4 illustrates the log results obtained from a test well construction comprising three half barrel stacked over a casing extension. From top to bottom barrel 3 (water and sand), barrel 4 (water/sand/tag) and barrel 1 (water/sand).

Results: Referring to FIG. 4: the log data shows depth in the y axis in feet. To the left of the depth axis is the natural gamma ray curve response in gamma counts per second. To the right of the depth track are the NN counts and the NG counts detected by the logging device. Results show that the presence of the tag can be detected by both NN and NG methods. The effect of the tag was to lower both the NN and NG counts. The decreasing gamma counts may be counter intuitive to the hypothesis as boron emits a high energy gamma upon neutron capture. The conclusion from this result is that the gamma related neutron ionization events are decreased with the early capture of neutrons. This should allow for the discrimination of near well bore and non-near wellbore tag placement as the field of investigation of the gamma detector is shallower than that of the neutron detector. FIG. 1 illustrates the concept of the field or volume of investigation. The shapes of the volumes are for illustration purposes only and do not necessarily reflect the true shape of the volume.

Example 2

Demonstration Well Field Test

Hypothesis: Fracture tag relative placement to wellbore can be discerned by the relative changes in neutron neutron and neutron gamma responses with the presence of tag and the tagging and non-tagging of fracture stages should be easily recognizable.

Materials: B4C, Logging device containing Am241Be neutron logging source, thermal neutron detector, neutron gamma detector and natural gamma detector; wireline logging unit comprising of sufficient length electric wireline and an acquisition system to record the data.

Method: Record before frac neutron neutron, neutron gamma and natural gamma ray responses. Tag frac stages as follows: pad stage—no tag, proppant stage 1—tag front and back of stage at 375 $g/m^3$ because it is believed that the initial stage of well fracturing will be up and down near wellbore. Therefore there is a possibility to detect the tagged and untagged stage if the vertical extent is high enough. Tagging the back of stage 1 will place a wall of tag near wellbore throughout the perforated interval. Proppant stage 2—no tag. This will allow this stage to make "windows" in the previous tagged wall. The displaced tag will be pushed further out from the wellbore. One frac theory suggests that this will happen similar to a sand dune appearance. Proppant stage 3—tag complete stage at 375 $g/m^3$. This stage was resin coated to create a sand barrier for the earlier frac stages to prevent sand returning during production. The entire stage was tagged to identify if "windows" in wall were plugged. Record after frac neutron neutron, neutron gamma and natural gamma ray responses. Shift after log responses to remove changes in borehole fluid salinity, which should appear as a "dc shift" component in the measurement. Compare before and after log responses to detect the presence and relative placement of tag and placement of stages.

Figure 6:
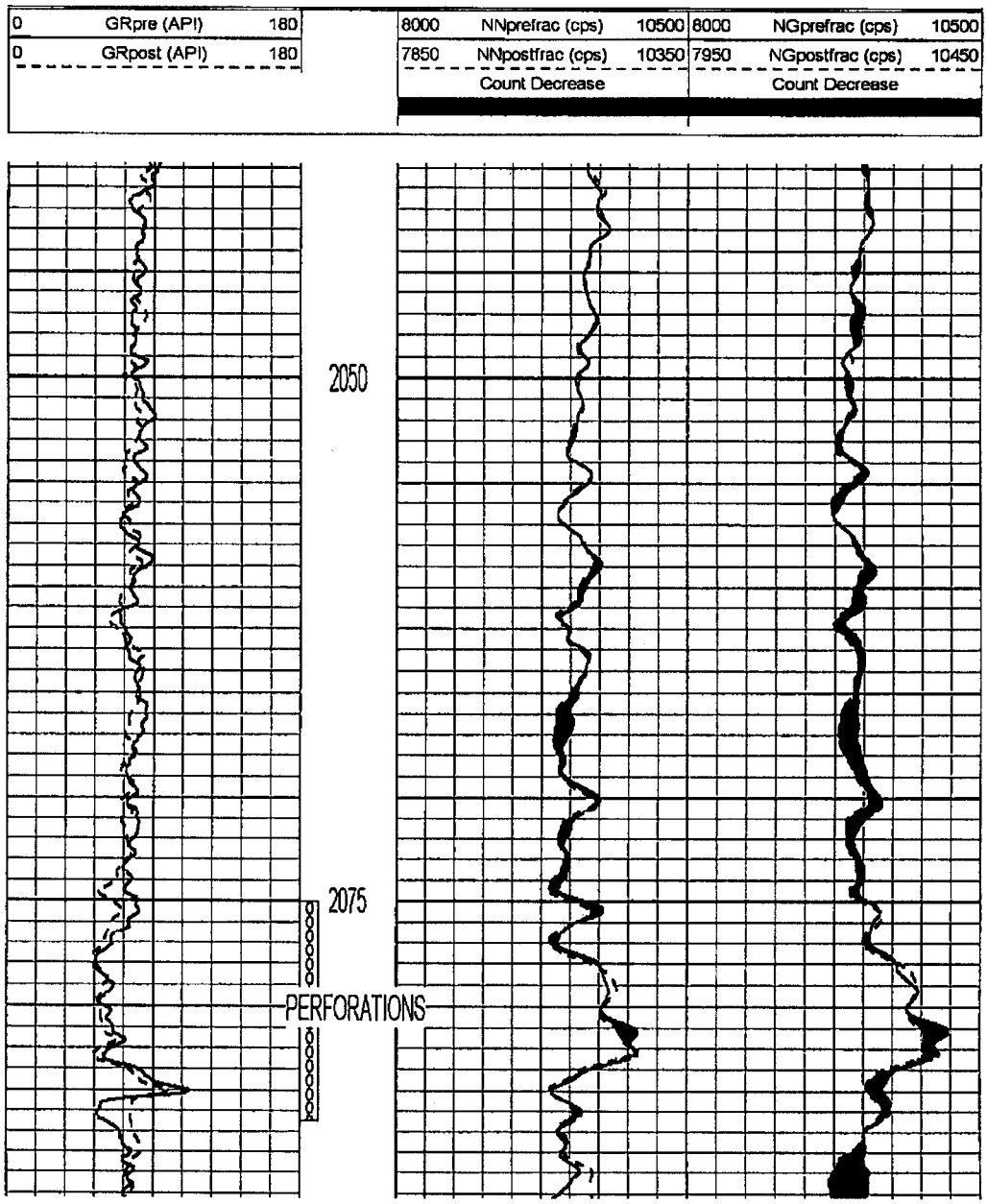
FIG. 6 illustrates a fracture analysis log showing gamma ray (pre and post frac), neutron neutron (pre and post frac), and neutron gamma (pre and post frac).

Results: Referring to FIG. 6, vertical axis or y axis represents depth in the well (shallower depths towards top) and the various x axes represents counts per second for detectors. Shading explanation is given on FIG. 6. The first observation is that similar results are recognized as in the previous experiment. Across the perforated interval the, NN and NG activity decreased due to the presence of the tag. Two smaller intervals indicated an increase in both count rates indicating the total lack of tag. Above the perforated interval, both NN and NG show decreases in count rates between Pre-Frac and Post-Frac measurements.

Interpretation: Referring to FIG. 5, vertical axis or y axis represents depth in the well (shallower depths towards top) and the various x axes represents counts per second for detectors.

Gamma Effect—Measured reduction in Neutron Gamma counts per second between Pre-Frac and Post-Frac.

Neutron Effect—Two times the measured reduction in Neutron Neutron counts per second between Pre-Frac and Post-Frac. Two times multiplier used to compensate for differences in total count rates between neutron neutron and neutron gamma.

No Tag Effect—Four times the increase in Neutron Gamma and Neutron Neutron counts per second between Pre-Frac and Post-Frac. Four times multiplier used to exemplify effect on presentation.

GR Increase—Increase in natural gamma ray counts per second between Pre-Frac and Post-Frac.

Shading explanation is given on FIG. 5.

Decreasing NN and NG indicates near wellbore presence of tag. In cases where NN decreases exceeded relative decreases of NG, the interpretation is that the tag is located near and far from wellbore relative to NG and NN volumes of investigation. Neutron neutron increases and neutron gamma increases indicate no tag presence and change in measurement matrix due to frac sand (stage 2). Neutron neutron decreases and no change in neutron gamma indicates non near wellbore tag positions. The upper shoulders of the "windowed" no tag stage show only NN tag effects. This indicates that only far tag effects are present and indicate that the tagged "wall" from the prior stage was pushed back and up.

The natural gamma response comparison also shows an increase in natural radioactivity after the fracturing operation. The only source of natural gamma radiation high enough to attain levels as measured are found in the formation immediately above. There is also a noticeable reduction in gamma levels from this formation. The interpretation is that that the fracturing operation eroded the high gamma formation and the eroded material was deposited below, causing the abnormal increase in natural gamma activity 100.

We claim:

1. A method of discerning between relative near and relative far borehole placement of a fluid displaced in the borehole, characterized in that said method comprises:

(a) tagging the fluid with a neutron absorber;

(b) disposing the tagged fluid into borehole;

(c) logging the borehole with an instrument capable of measuring a neutron capture and a gamma radiation response in and around the borehole; and (d) comparing the neutron capture and gamma radiation measurements with a baseline neutron capture and gamma radiation measurements of the borehole, wherein a decrease in both neutron capture and gamma radiation represents relative near borehole placement of the fluid, and wherein a decrease in only the neutron capture represents a relative far borehole placement of the fluid.

2. The method of claim 1, characterized in that said method further comprises measuring a natural gamma of the borehole.

3. The method according to any one of claims 1 and 2, characterized in that said tagged fluid is disposed into the borehole in alternate stages.

4. The method of claim 3, characterized in that the instrument is a logging tool, said logging tool including a neutron source, a neutron detector and a gamma radiation detector.

5. The method of claim 2, characterized in that the measuring step is performed with a logging tool, said logging tool including a neutron source, a neutron detector, a neutron gamma detector, and a natural gamma detector.

6. The method of claim 4, characterized in that the neutron source comprises a geophysical accelerator or a chemical source of neutrons.

7. The method according to any one of claims 1 and 2, characterized in that said fluid is selected from the group consisting of: proppant slurry, hydraulic fluid and cement.

8. The method according to any one of claims 1 and 2, characterized in that the neutron absorber is cadmium, boron or a combination thereof.

9. The method according to any one of claims 1 and 2, characterized in that the neutron absorber is boron carbide.

10. The method of claim 5, characterized in that the neutron source comprises a geophysical accelerator or a chemical sources of neutrons.

* * * * *